US009986836B2

(12) United States Patent
Pectol

(10) Patent No.: US 9,986,836 B2
(45) Date of Patent: Jun. 5, 2018

(54) TWO-PART STACKING CHAIR

(71) Applicant: Mity-Lite, Inc., Orem, UT (US)

(72) Inventor: Matt Pectol, Fruit Heights, UT (US)

(73) Assignee: Mity-Lite, Inc., Orem, UT (US)

( * ) Notice: Subject to any disclaimer, the term of this patent is extended or adjusted under 35 U.S.C. 154(b) by 0 days. days.

(21) Appl. No.: 15/340,786

(22) Filed: Nov. 1, 2016

(65) Prior Publication Data

US 2017/0119158 A1 May 4, 2017

Related U.S. Application Data

(60) Provisional application No. 62/250,264, filed on Nov. 3, 2015.

(51) Int. Cl.

| | |
|---|---|
| ***A47C 7/02*** | (2006.01) |
| ***A47C 4/02*** | (2006.01) |
| ***A47C 3/04*** | (2006.01) |

(52) U.S. Cl.

CPC ..... *A47C 4/024* (2013.01); *A47C 3/04* (2013.01)

(58) Field of Classification Search

CPC ..... A47C 4/024; A47C 3/04

USPC ..... 297/440.1, 440.14, 440.15, 445.1, 446.1, 297/446.2, 450.1

See application file for complete search history.

(56) References Cited

U.S. PATENT DOCUMENTS

| | | | | | |
|---|---|---|---|---|---|
| 98,440 | A | * | 12/1869 | Smith | A47C 5/04 297/446.2 |
| 2,709,485 | A | * | 5/1955 | Haven | A47C 4/02 297/446.1 |
| 2,961,037 | A | * | 11/1960 | Keefer | A47C 7/185 297/440.15 X |
| 3,000,669 | A | * | 9/1961 | Silverman | A47C 5/04 297/451.1 |
| 3,127,216 | A | * | 3/1964 | Clouse | A47C 7/282 297/440.15 X |
| 3,455,605 | A | * | 7/1969 | Anderson | A47C 5/12 297/446.2 X |
| 3,467,434 | A | * | 9/1969 | Barker | A47C 4/02 297/440.1 |
| 3,556,594 | A | * | 1/1971 | Anderson | A47C 4/02 297/445.1 X |
| 4,301,985 | A | * | 11/1981 | Ballard | A47C 4/02 297/440.1 X |

(Continued)

OTHER PUBLICATIONS

MityLite,"Worship Series," 2 pgs., http://www.mitylite.com/product/banquet-chairs As accessed on this date: Nov. 14, 2016.

(Continued)

*Primary Examiner* — Rodney B White

(74) *Attorney, Agent, or Firm* — Thorpe, North & Western, LLP

(57) ABSTRACT

A two-piece chair frame assembly comprises a back piece and a front piece joined together to form a chair frame. The back and front pieces are separate and discrete pieces until joined together. The back piece comprises a pair of rear legs, a backrest frame, and a back seat frame portion. The front piece comprises a pair of front legs and a front seat frame portion. The front and back seat frame portions join together to form a seat frame. The back and front pieces have different surface characteristics.

20 Claims, 12 Drawing Sheets

(56) References Cited

U.S. PATENT DOCUMENTS 4,436,342 A * 3/1984 Nilson ..... F16B 12/20 297/446.1 X
4,577,906 A * 3/1986 Hsiung ..... A47C 4/024 297/446.1 X
5,069,506 A * 12/1991 Wieland ..... A47C 4/02 297/440.15 X
5,088,180 A * 2/1992 Nottingham ..... A47C 3/00 297/440.1 X
5,332,289 A * 7/1994 Nottingham ..... A47C 3/00 297/440.15 X
5,358,309 A * 10/1994 Fedele ..... A47C 3/00 297/440.1
5,382,080 A * 1/1995 Gamberini ..... A47C 3/025 297/445.1 X
5,865,508 A * 2/1999 Martin ..... A47C 3/00 297/440.15
6,017,092 A * 1/2000 Lee ..... A47C 3/00 297/446.2 X
6,666,518 B2 * 12/2003 Bruschi ..... A47C 3/04 297/440.14 X
6,725,523 B2 * 4/2004 Chiang ..... A47C 3/00 297/440.15 X
7,296,859 B1 * 11/2007 Branch ..... A47C 3/029 297/440.14
7,351,577 B2 4/2008 Couto et al.
7,510,244 B1 * 3/2009 Shin ..... A47C 1/12 297/446.2 X
7,654,617 B2 2/2010 Farnsworth
7,708,349 B2 * 5/2010 Chen ..... A47C 1/124 297/445.1 X
8,096,621 B2 * 1/2012 Braun ..... B60N 2/682 297/440.15 X
8,128,173 B2 * 3/2012 Huang ..... A47C 4/024 297/440.15 X
8,870,290 B2 * 10/2014 Xu ..... A47C 4/02 297/440.18
2004/0041453 A1 * 3/2004 Ellis ..... A47C 1/023 297/445.1 X
2004/0232746 A1 * 11/2004 Barile, Jr. ..... A47C 3/04 297/446.1 X
2009/0072599 A1 * 3/2009 Xu ..... A47C 3/04 297/446.1 X
2015/0296986 A1 10/2015 Rogers

OTHER PUBLICATIONS

MityLite,"Grand Series," 2 pgs., http://www.mitylite.com/product/banquet-chairs As accessed on this date: Nov. 14, 2016.
MityLite,"Prestige Series," 2 pgs., http://www.mitylite.com/product/banquet-chairs As accessed on this date: Nov. 14, 2016.
MityLite,"Regency Series," 2 pgs., http://www.mitylite.com/product/banquet-chairs As accessed on this date: Nov. 14, 2016.
MityLite,"Classic Series," 2 pgs., http://www.mitylite.com/product/banquet-chairs As accessed on this date: Nov. 14, 2016.
MityLite,"Essential-II Series," 2 pgs., http://www.mitylite.com/product/banquet-chairs As accessed on this date: Nov. 14, 2016.
MityLite,"Elite Series," 2 pgs., http://www.mitylite.com/product/banquet-chairs As accessed on this date: Nov. 14, 2016.
MityLite,"Access Series," 2 pgs., http://www.mitylite.com/product/banquet-chairs As accessed on this date: Nov. 14, 2016.
MityLite,"Royale Series," 2 pgs., http://www.mitylite.com/product/banquet-chairs As accessed on this date: Nov. 14, 2016.
MityLite,"Grand II Series," 2 pgs., http://www.mitylite.com/product/banquet-chairs As accessed on this date: Nov. 14, 2016.
MityLite,"Encore Series," 2 pgs., http://www.mitylite.com/product/banquet-chairs As accessed on this date: Nov. 14, 2016.
MityLite,"Eon Series," 2 pgs., http://www.mitylite.com/product/banquet-chairs As accessed on this date: Nov. 14, 2016.

* cited by examiner

TWO-PART STACKING CHAIR

PRIORITY CLAIM(S)

Priority is claimed to U.S. Provisional Patent Application Ser. No. 62/250,264, filed Nov. 3, 2015, which is hereby incorporated herein by reference in its entirety.

BACKGROUND

Field of the Invention

The present invention relates generally to stacking and/or banquet chairs.

Related Art

The development and advancement of stacking and banquet chairs is an ongoing endeavor.

SUMMARY OF THE INVENTION

It has been recognized that it would be advantageous to develop a stacking banquet chair with a unique visual appearance, such as a two-tone affect. In addition, it has been recognized that it would be advantageous to develop a stacking banquet chair in which different visual or aesthetic characteristics can be easily combined.

The invention provides a two-piece chair frame assembly comprising a back piece and a front piece joined together to form a chair frame. The back and front pieces are separate and discrete pieces until joined together. The back piece comprises a pair of rear legs, a backrest frame, and a back seat frame portion. The front piece comprises a pair of front legs and a front seat frame portion. The front and back seat frame portions join together to form a seat frame. The back and front pieces have different surface characteristics.

In accordance with a more detailed aspect of the invention, the back seat frame portion comprises: 1) a rear spar extending between the pair of rear legs; and 2) an attachment insert extending forwardly from a proximal end at the rear spar to a distal free end. The front seat frame portion comprises: 1) a front spar extending between the pair of front legs; 2) a pair of side spars extending rearwardly from the pair of front legs to distal free ends: 3) a distal flange extending laterally between the distal free ends of the pair of side spars; and 4) an intermediate flange at an intermediate point of the pair of side spars. The back and front seat frame portions join together with the attachment insert of the back seat frame portion inserted between the pair of side spars of the front seat frame portion. The distal free end of the attachment insert of the back seat frame portion is affixed to the intermediate flange of the front seat frame portion. The proximal end of the attachment insert of the back seat frame portion is affixed to the distal flange of the front seat frame portion.

In accordance with another more detailed aspect of the invention, the different surface characteristics comprise at least: 1) a color of the pair of front legs being different than a color of the pair of rear legs or the backrest frame; 2) a surface finish of the pair of front legs being different than a surface finish of the pair of rear legs or the backrest frame; 3) a profile shape of the pair of front legs being different than a profile shape of the pair of rear legs or the backrest frame; or 4) combinations thereof

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1:
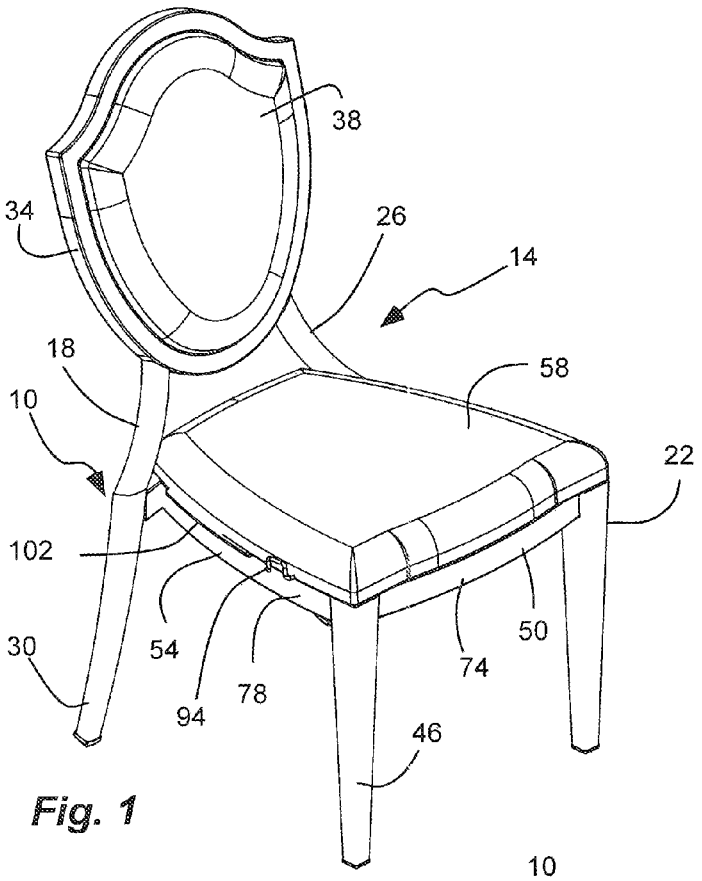
FIG. 1 is a perspective view of a chair formed by a two-piece chair frame assembly in accordance with an embodiment of the invention.
Figure 2:
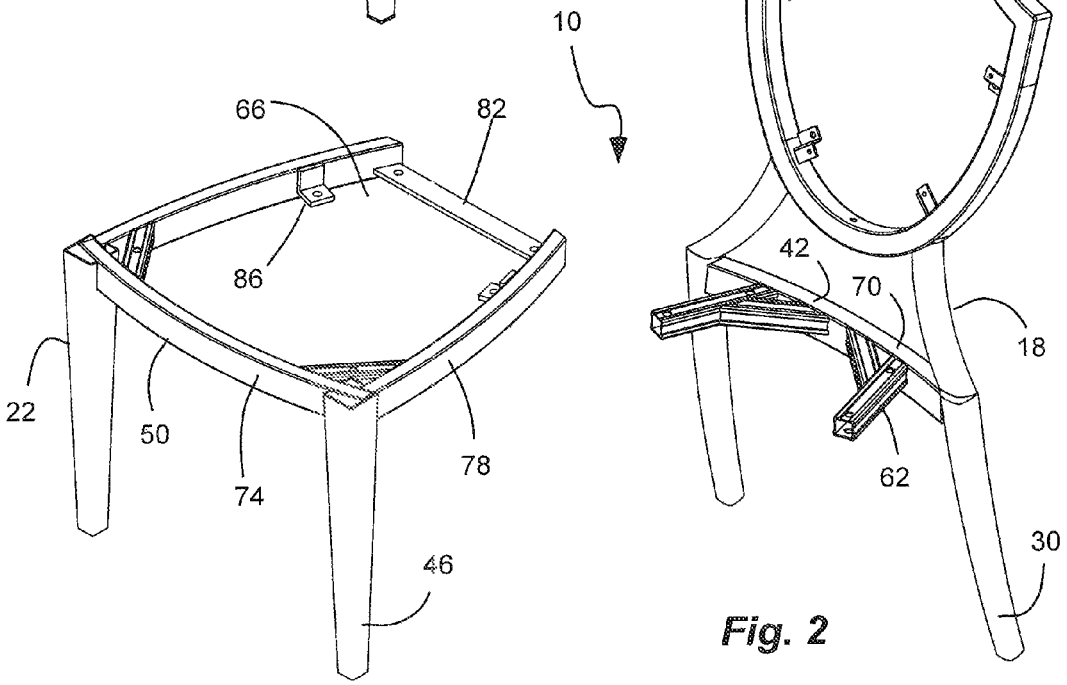
FIG. 2 is an exploded perspective view of the two-piece chair frame assembly of FIG. 1.
Figure 3A:
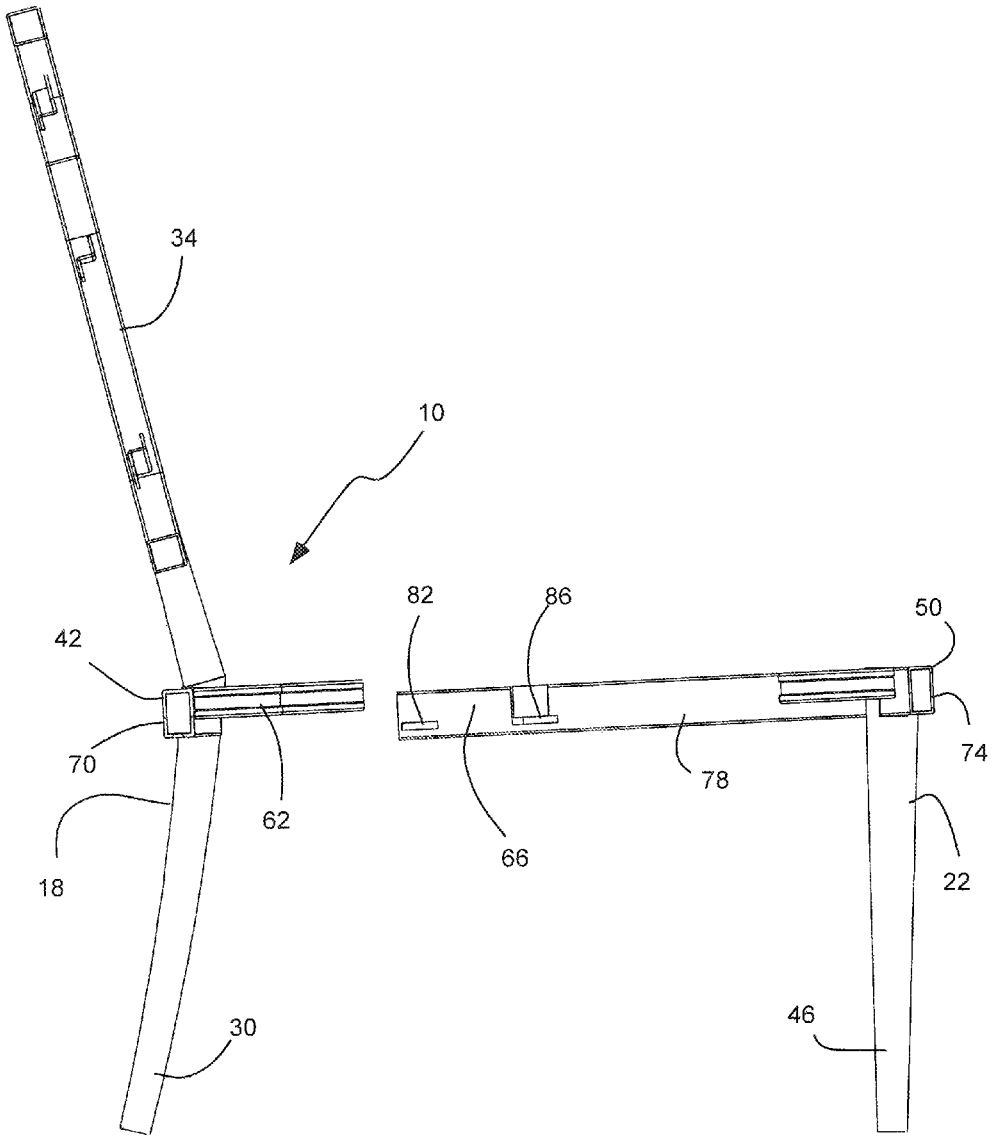
FIG. 3*a* is an exploded, cross-sectional side view of the two-piece chair frame assembly of FIG. 1.
Figure 3B:
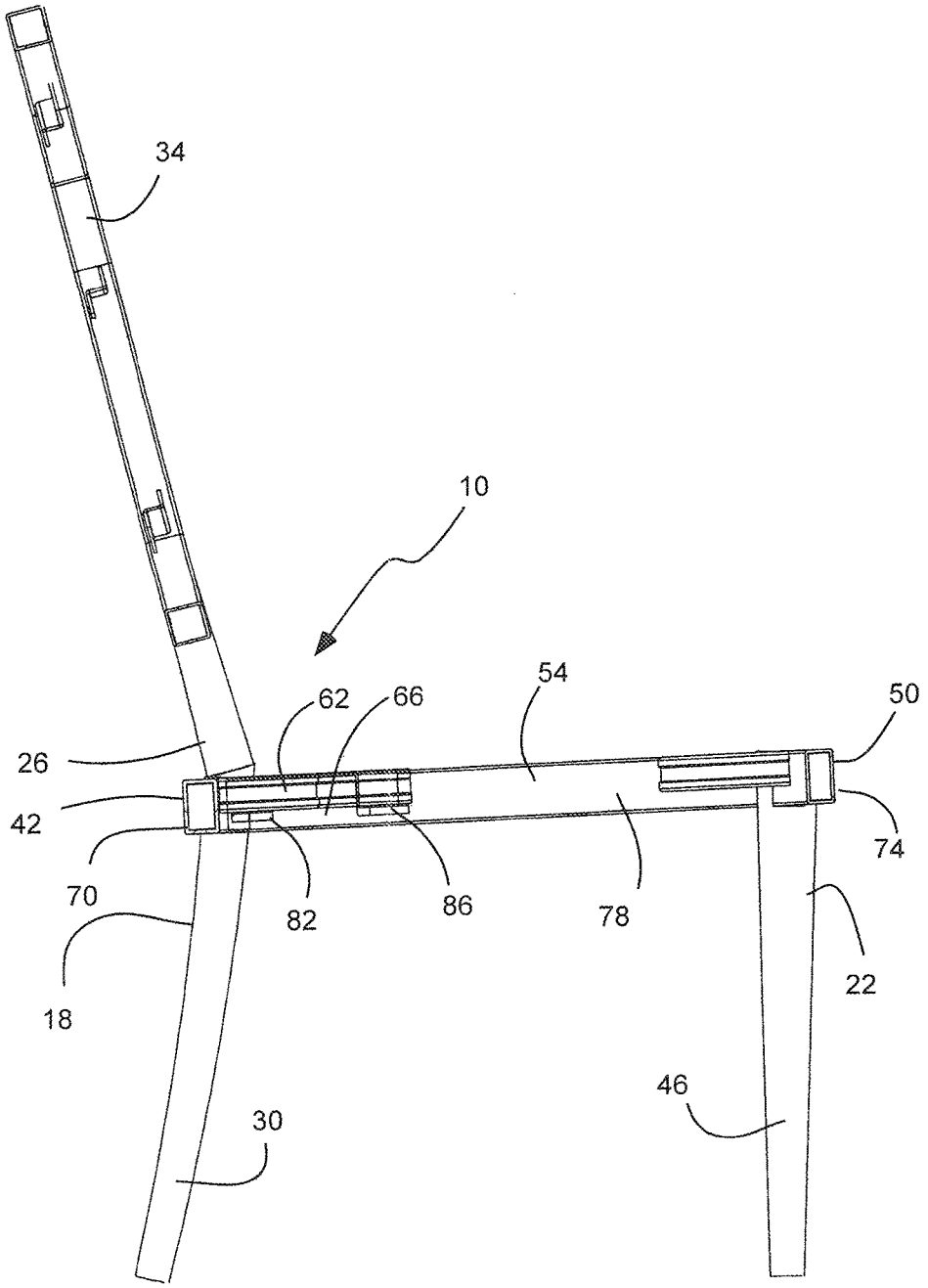
FIG. 3*b* is a cross-sectional side view of the two-piece chair frame assembly of FIG. 1.
Figure 4:
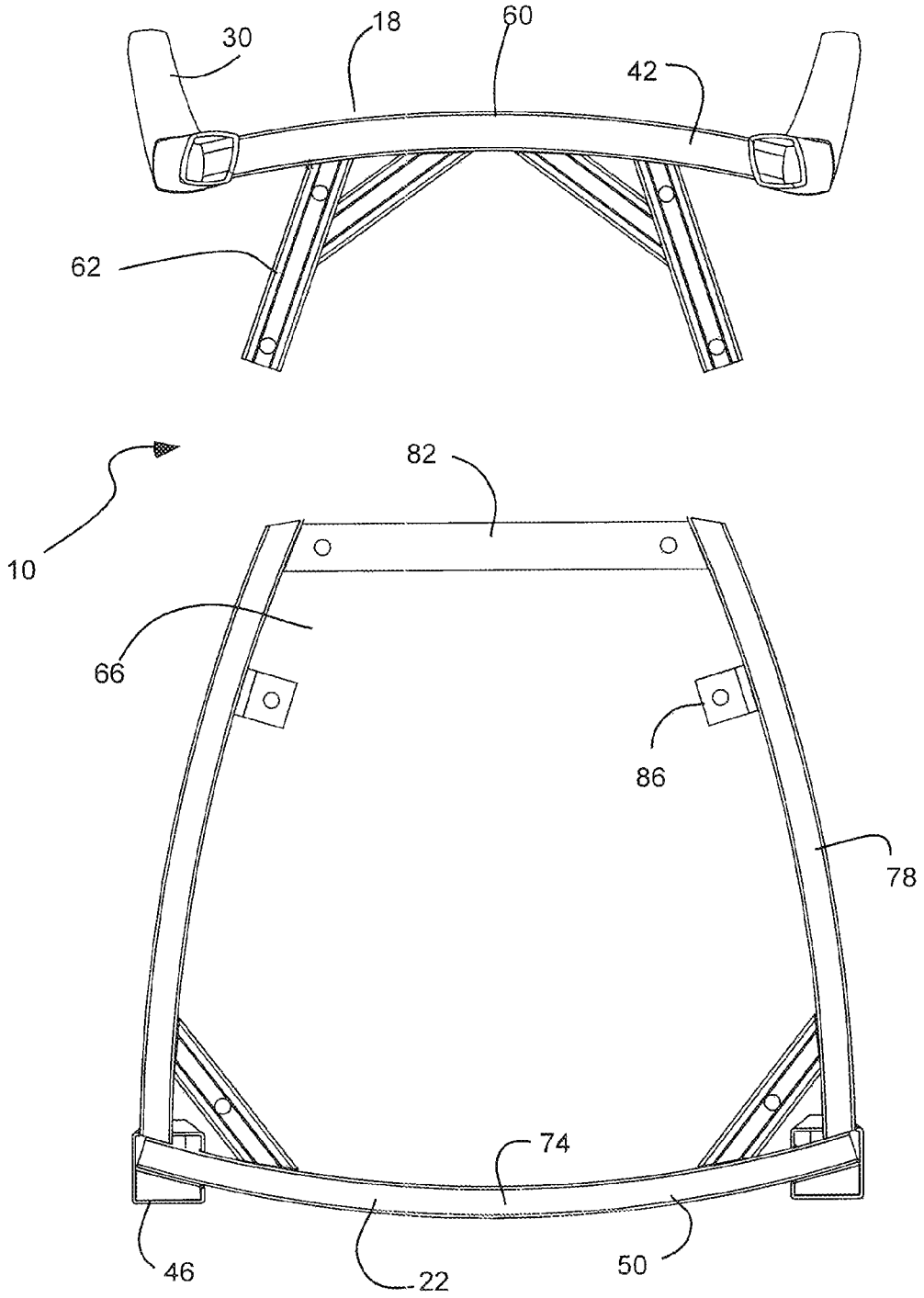
FIG. 4 is an exploded, partial top view of the two-piece chair frame assembly of FIG. 1.
Figure 5:
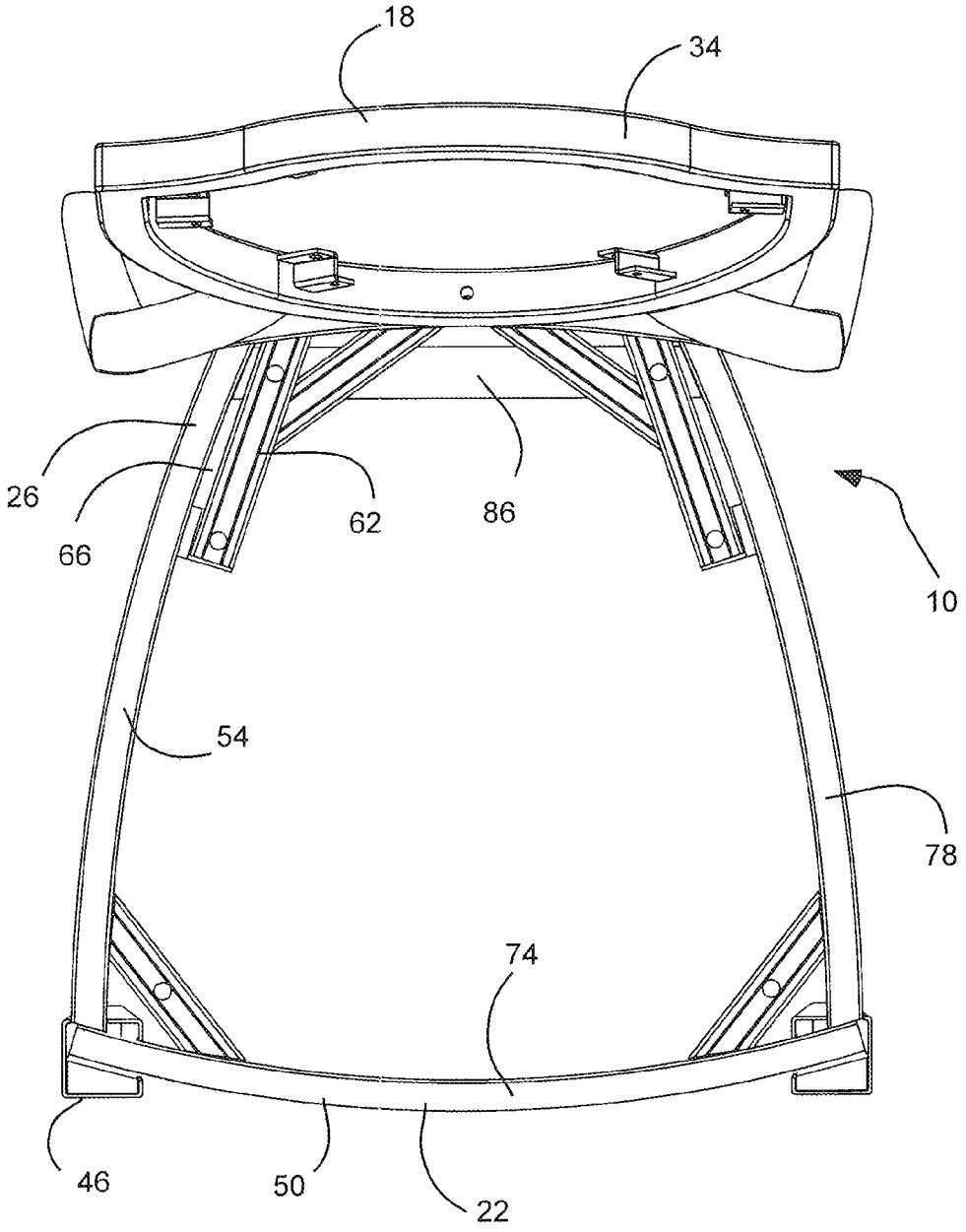
FIG. 5 is a top view of the two-piece chair frame assembly of FIG. 1.
Figure 6:
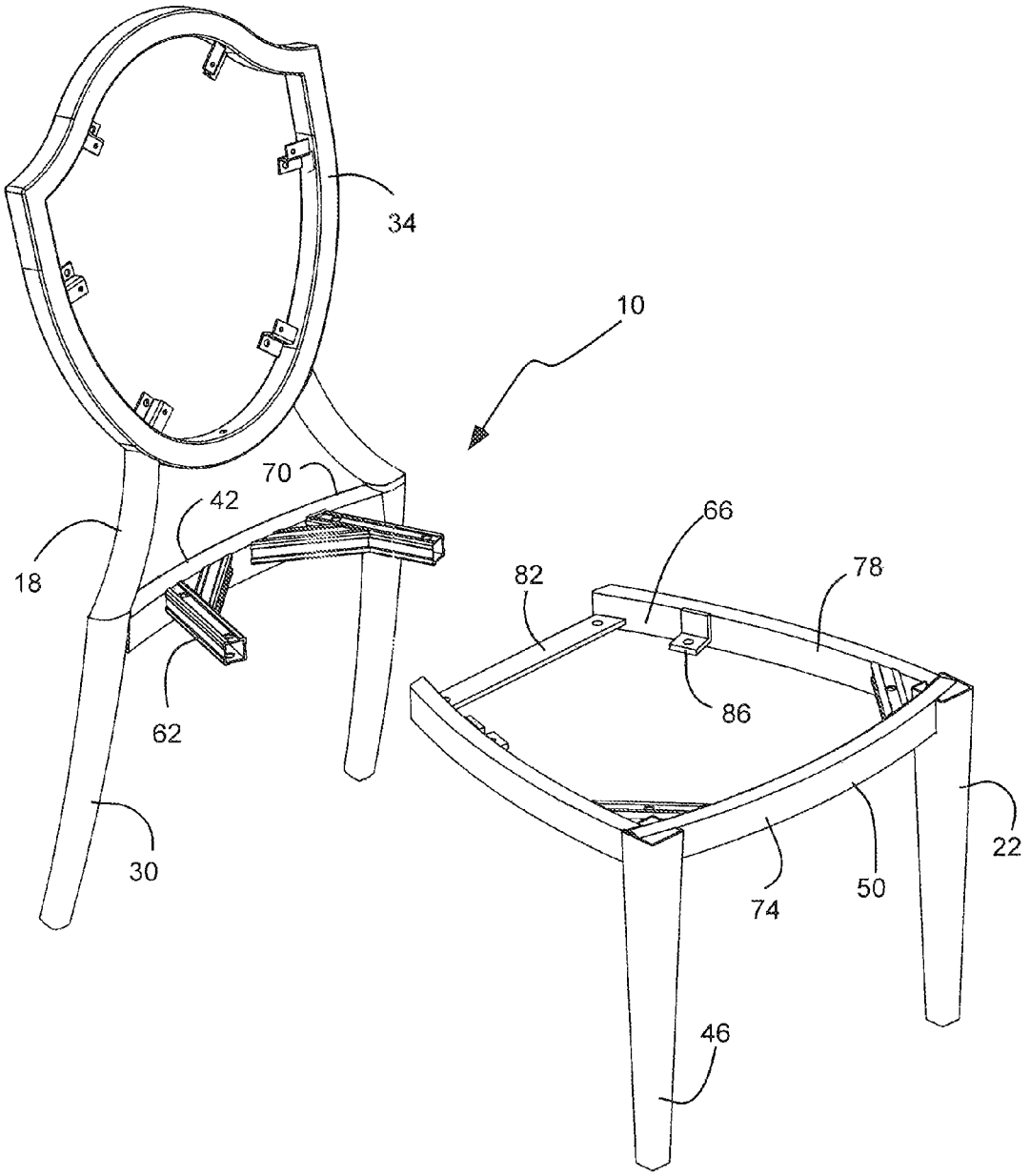
FIG. 6 is an exploded perspective view of the two-piece chair frame assembly of FIG. 1.
Figure 7:
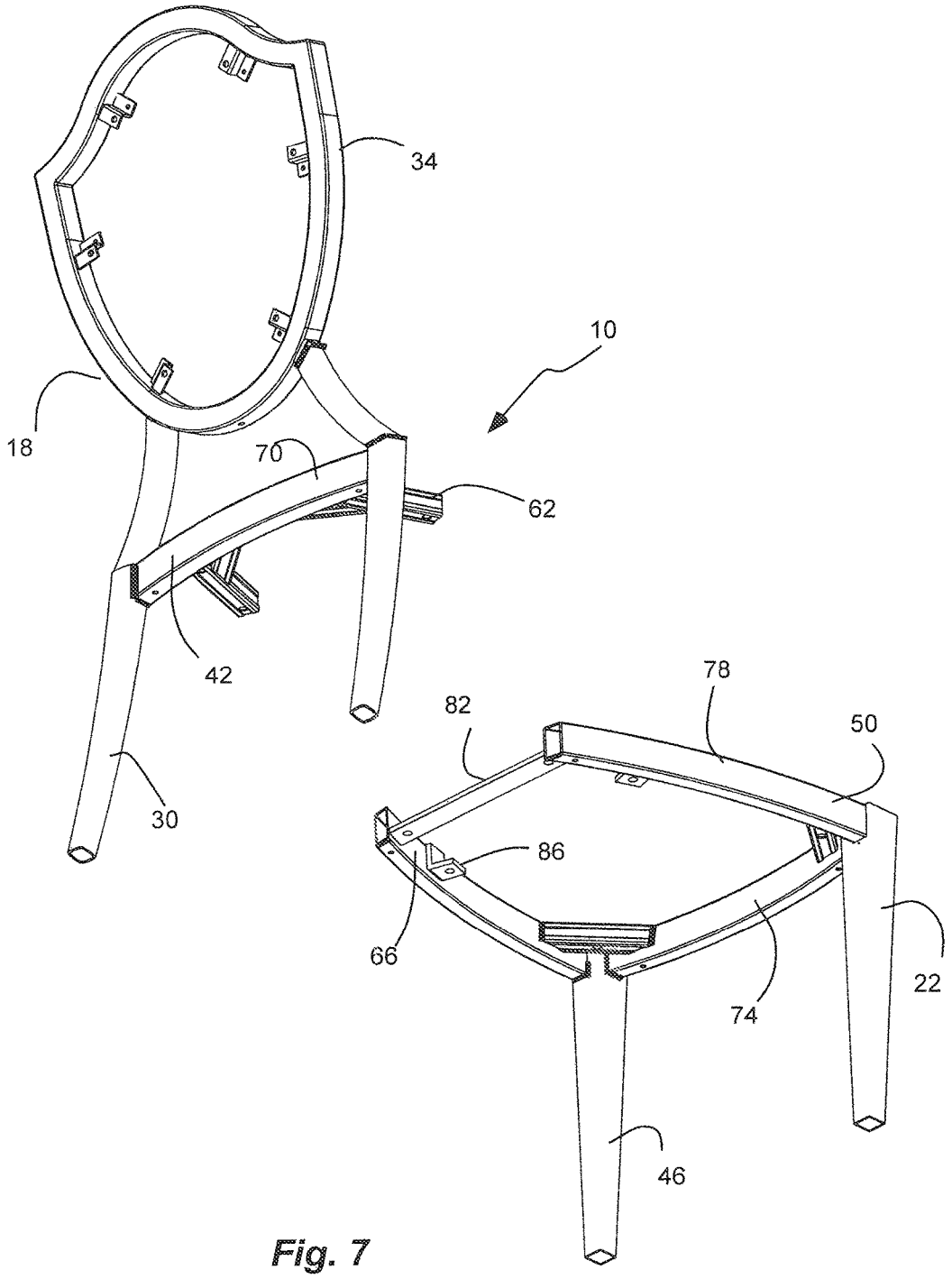
FIG. 7 is an exploded bottom perspective view of the two-piece chair frame assembly of FIG. 1.
Figure 8:
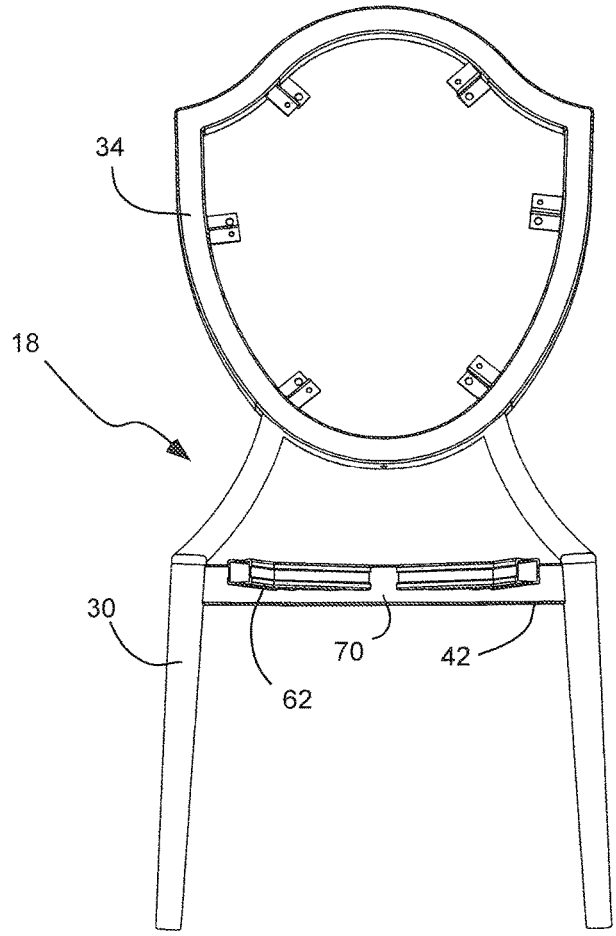
FIG. 8 is front view of a back piece of the two-piece chair frame assembly of FIG. 1.
Figure 9:
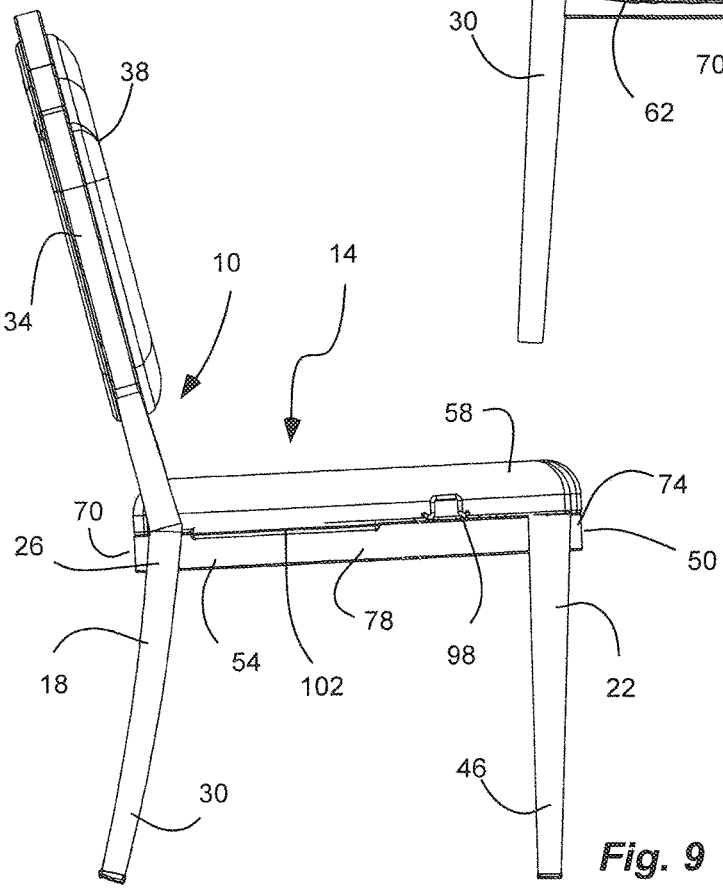
FIG. 9 is a side view of the chair of FIG. 1.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An embodiment of the invention provides a multi-piece chair frame assembly joinable together to form a chair, such as a stackable banquet chair. The frame assembly can be formed in multiple parts, such as two parts, that have different visual or aesthetical characteristics, to be combined for a finished chair or frame. In addition, different combinations or custom configurations can be obtained by combining different complimentary parts. The multiple parts can be provided with different surface characteristics so that a part can be selected with a desired surface characteristic and combined with another part also selected with a different desired surface characteristic to form a chair frame with a desired combined characteristic.

As illustrated in FIGS. 1-12*d*, a two-piece chair frame assembly, indicated generally at 10, in an example implementation in accordance with the invention is shown for forming a chair 14, such as a stackable banquet chair. The two-piece chair frame assembly 10 has a back piece 18 and a front piece 22 joined together to form a chair frame 26. In one aspect, the back and front pieces 18 and 22 can be removably joined together, and can be separable. The back and front pieces 18 and 22 are separate and discrete pieces (as shown in FIGS. 2, 3*a*, 4, 6 and 7) until joined together as the chair frame 26 (as shown in FIGS. 1, 3*b*, 5 and 9). The chair frame 26 or frame assembly 10 can receive and carry a seat cushion disposable on and secured to a seat frame 54, and a backrest cushion secured to and carried by a backrest frame 34.

The back piece 18 of the chair frame 26 or frame assembly 10 can comprise a pair of rear legs 30, a backrest frame 34 (carrying the backrest 38 with a backrest cushion), and a back seat frame portion 42 (or portion of a seat frame disposed at a rear of the seat frame proximate the rear legs and backrest frame). The backrest frame and the backrest can have various different shapes. The front piece 22 of the chair frame 26 or frame assembly 10 can comprise a pair of front legs 46, and a front seat frame portion 50 (or portion of a seat frame disposed at a front of the seat frame proximate the front legs). The front and back seat frame portions 50 and 42 can be join together to form a seat frame 54, and to couple the back and front pieces 42 and 50 together (and to couple the front legs to the rear legs and the backrest frame). The seat frame 54 can carry a seat 58 with a seat cushion. In one aspect, the front and back seat frame portions 50 and 42 can be removable joined together, and can be separable.

The front and back seat frame portions 50 and 42, and the front and back piece 22 and 18, have an insert extending from one into a recess in the other to connect the two together and to provide stability. In one aspect, the back seat frame portion 42, and the back piece 18, can comprise an insert 62 insertable into and disposed within a recess 66 of the front seat frame portion 50, and the front piece 22. The back and front seat frame portions 50 and 42 can have structure of the back seat frame portion received inside structure of the front seat frame portion. The insert 62 of the back seat frame portion 50, and the back piece 18, can be removably secured to the front seat frame portion 50, and the front piece 22.

The back seat frame portion 42 can comprise a rear spar 70 extending between the pair of rear legs 30, such as at a top of the rear legs and a bottom of the backrest frame 34. In addition, the back seat frame portion 42 can also comprise the attachment insert 62 extending forwardly from a proximal end at the rear spar 70 to a distal free end. In one aspect, the attachment insert 62 can comprise a pair of spaced-apart extensions. The proximal end of the attachment insert 62 and the extensions can be narrower than the distal end of the of attachment insert and the extension, such that the attachment insert and the extension expand or flare outwardly to match the front seat frame portion and recesses thereof. In addition, the proximal end of the attachment insert 62 and the extensions is recessed inwardly with respect to the pair of rear legs 30 to facilitate stacking, and receiving the rear legs of an upper chair disposed on a lower chair. Thus, the seat 58 can have a wider front and a narrower back, less than a distance between the rear legs 30.

The front seat frame portion 50 can comprise a front spar 74 extending between the pair of front legs 46, such as at the tops of the front legs. In addition, the front seat frame portion 50 can also comprise a pair of side spars 78 extending rearwardly from the pair of front legs 30 to distal free ends. The side spars 78 can also extend from the tops of the front legs. The tops of the front legs can be slotted to receive the ends of the front spar 74 and the proximal ends of the side spars 78. In one aspect, the pair of side spars 78 taper inwardly and rearwardly from the pair of front legs 46 to the rear spar 70. Thus, the side spars 78 of the front seat frame portion 50 can match and be substantially parallel with the insert, or extensions, of the rear seat frame portion 42. Again, the taper of the side spars facilitates stacking of one chair atop another, with the chair frame 26 being an upper chair frame of an upper chair stackable on another lower chair frame of a lower chair with the pair of side spars of the lower chair frame received within the rear legs of the upper chair frame.

Furthermore, the front seat frame portion 50 can further comprise a distal flange 82 and an intermediate flange 86. In one aspect, the distal flange 82 can extend laterally between the distal free ends of the pair of side spars 78. In another aspect, the distal flange can be a pair of flanges each at a different distal end of the side spars. The intermediate flange 86 is disposed at an intermediate point of the pair of side spars 78, between the proximal and distal ends. In one aspect, the intermediate flange 86 can be a pair of flanges each on a different side spar. In another aspect, the intermediate flange can be a single flange extending between the side spars.

The back and front seat frame portions 42 and 50 join together with the attachment insert 62 of the back seat frame portion 42 inserted between the pair of side spars 78 of the front seat frame portion 50. The distal free end of the attachment insert 62 of the back seat frame portion 42 is affixed, such as with threaded fasteners, to the intermediate flange 86 of the front seat frame portion 50. Similarly, the proximal end of the attachment insert 62 of the back seat frame portion 42 is affixed, such as with threaded fasteners, to the distal flange 82 of the front seat frame portion 50. Thus, the attachment insert 62 of the back seat frame portion 42 is attached to the pair of side spars 78 of the front seat frame portion 50 at the distal ends of the pair of side spars, and the intermediate portion of the pair of side spars.

A method for assembling the chair 14 and/or the chair frame 26 comprises: inserting the attachment insert 62 of the back seat frame portion 42 between the pair of side spars 78 of the front seat frame portion 50; attaching the attachment insert 62 of the back seat frame portion 42 to the distal flange 82 and the intermediate flange 86 of the front seat frame portion forming the seat frame 54; and attaching the seat 58 to the seat frame 54 with the attachment insert 62 between the seat 58 and the distal flange 82 and the intermediate flange 86 of the front seat frame portion 50.

The front and back seat frame portions 50 and 42 can be formed of metal, and can be formed by bending and/or welding. The legs and spars can be formed by tubular members cut, shaped and joined together, either with mechanical fasteners, or by welding, or both.

As described above, the front and back pieces 22 and 18, and the front and back seat frame portions 50 and 42, can be removably coupled together, such as by threaded fasteners joining the insert 62 of the back seat frame portion 42 to the distal and intermediate flanges 82 and 86 of the front seat frame portion 50 or side spars 78 thereof. The joining of the front and back seat frame portions 50 and 42 also forms the seat frame 54 that carries the seat 58. The seat 58 is disposed on and secured to the seat frame 54. The seat 58 can be removably coupled to the seat frame 54 by removable fasteners. In addition, the attachment insert 62 of the back seat frame portion 42 is sandwiched between the seat 58 and the distal flange 82 and the intermediate flange 86 of the front seat frame portion 50.

The back and front pieces 18 and 22 of the chair frame 26 can have different surface characteristics. In one aspect, at least the pair of back legs 30 and the pair of front legs 46 have different surface characteristics. In another aspect, the pair of back legs 30, the rear spar 70 and the backrest frame 34 can have different surface characteristics than the pair of front legs 46 and the front spar 74 and the side spars 78. The different surface characteristics can comprise: color, surface finish, profile shape, cross-sectional shape, or combinations thereof. The colors of the back and front pieces 18 and 22, or the back and front seat frame portions 42 and 50, can be different. In one aspect a color of the pair of front legs is different than a color of the pair of rear legs or the backrest frame. The different surface finishes of the back and front pieces 18 and 22, or the back and front seat frame portions 42 and 50, can comprise: gloss, semi-gloss, matte, satin, textured, smooth, etc., or combinations thereof. In one aspect, a surface finish of the pair of front legs is different than a surface finish of the pair of rear legs or the backrest frame. The different profile shape can include a profile shape of the pair of front legs being different than a profile shape of the pair of rear legs or the backrest frame. The front legs can be straight and can have a tapered profile from wider tops to narrower bottoms, while the rear legs can be arcuate and have a constant width. The components of the back and front pieces 18 and 22, or the back and front seat frame portions 42 and 50, can have different cross-sectional shapes formed by different type of tubular material, such as square, rectangular, circular, oval, etc. In one aspect, an entire surface of the pair of front legs 46, the front spar 74, and the pair of side spars 78 of the front piece 22 has a first surface characteristic; and an entire surface of the pair of rear legs 30, the rear spar 70 and the backrest frame 34 of the back piece 18 has a second surface characteristic, different from the first surface characteristic. Thus, the front and back pieces 22 and 18 can be separately manufactured with different surface characteristics, and combined together as desired to form a chair with the combined characteristics. Thus, the combined characteristics can have a synergistic effect. In addition, the different characteristics of the front and back pieces can be combined for custom affects. Furthermore, different back pieces can be provided with different backrest frames and backrests having different shapes.

A method for assembling the chair 14 and/or the chair frame 26 comprises: selecting a back piece 18 with a desired first surface characteristic from a group of back frame pieces with difference surface characteristics; selecting a front piece 22 with a desired second surface characteristic from a group of front frame pieces with difference surface characteristics; and joining the back piece 18 to the front piece 22 to form the chair frame 26.

Figure 10:
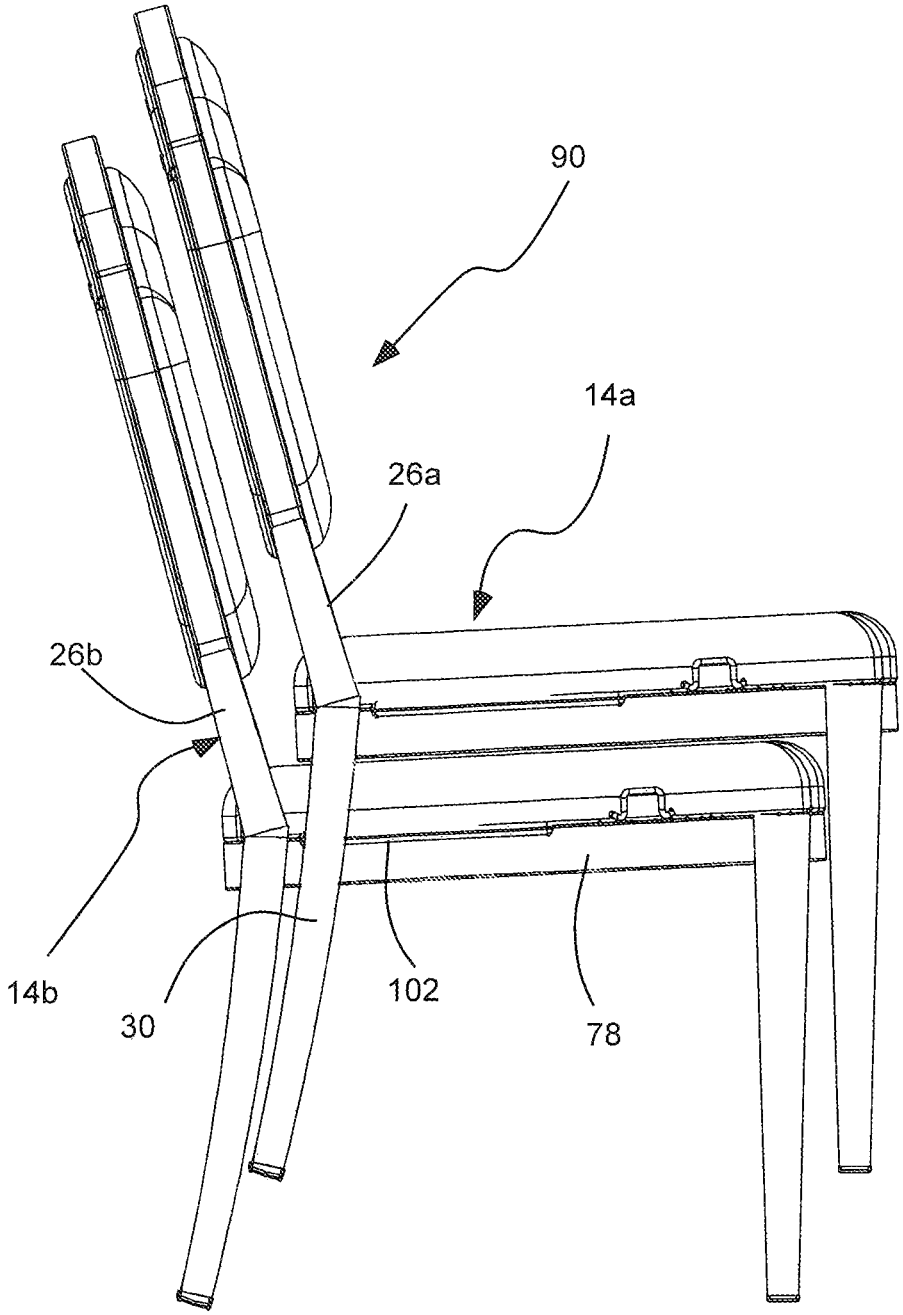
FIG. 10 is a side view of the chair of FIG. 1 shown in a stack of chairs.
Figure 11A:
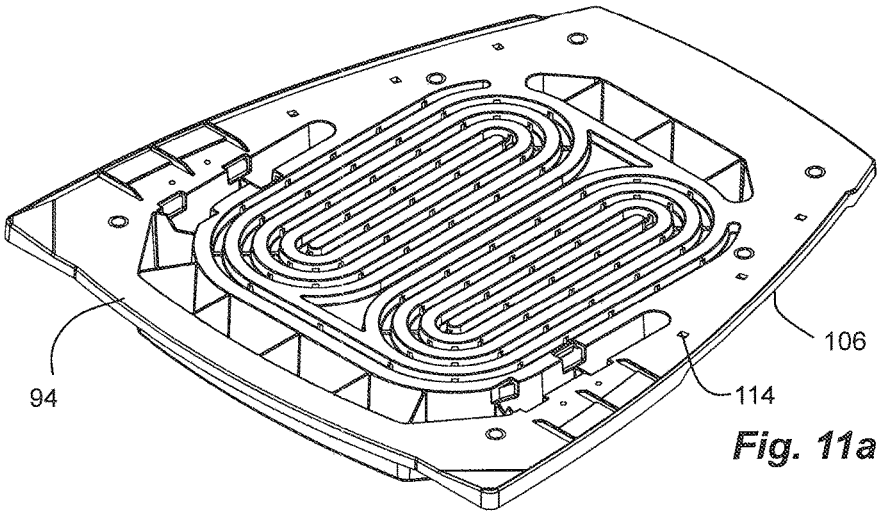
FIG. 11*a* is a perspective view of a seat base of a seat of the chair of FIG. 1.
Figure 11B:
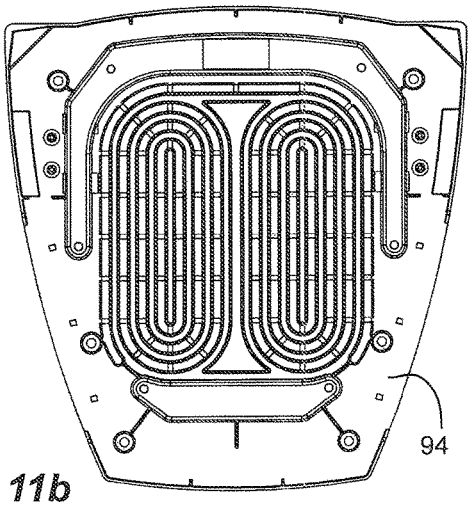
FIG. 11*b* is a top view of the seat base of FIG. 10*a*.
Figure 11C:
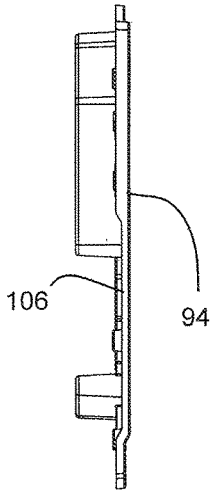
FIG. 11*c* is a side view of the seat base of FIG. 10*a*.
Figure 11D:
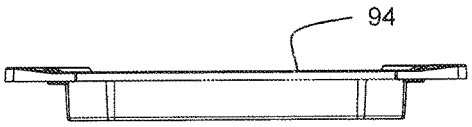
FIG. 11*d* is a rear view of the seat base of FIG. 10*a*.
Figure 12A:
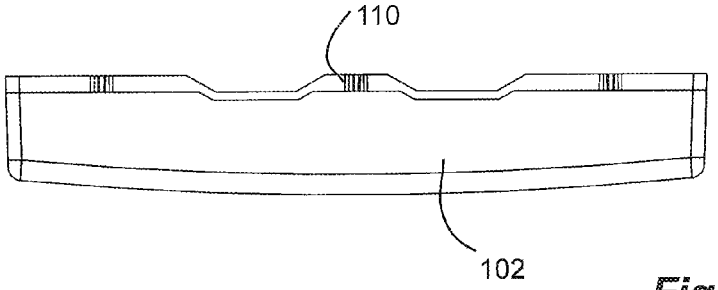
FIG. 12*a* is a top view of a bumper of the chair of FIG. 1.
Figure 12B:
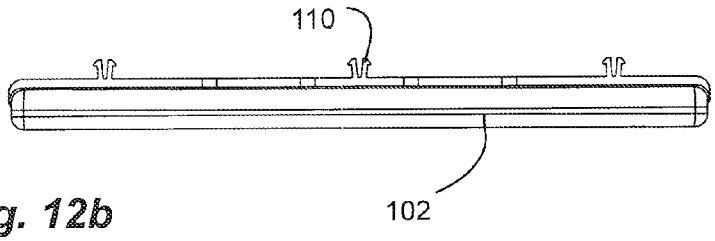
FIG. 12*b* is a side view of the bumper of FIG. 11*a*.
Figure 12D:
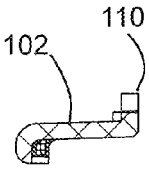
FIG. 12*d* is a cross-sectional end view of the bumper of FIG. 11*a*.
Figure 12C:
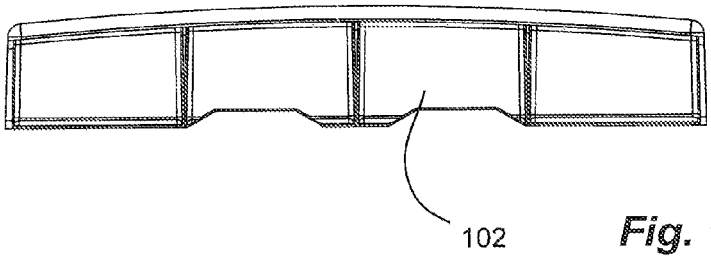
FIG. 12*c* is a bottom view of the bumper of FIG. 11*a*.

As described above, the chair 14 can be a stacking chair stackable with similar or identical chairs, to form a stack of chairs 90, as shown in FIG. 10. Thus, a rear portion of the seat, the distal ends of the side spars, and the insert can be recessed with respect to the rear legs. An upper chair frame 26*a* of an upper chair 14*a* is stackable on another lower chair frame 26*b* of a lower chair 14*b* with the pair of side spars 78 of the lower chair frame 26*b* received within the rear legs 30 of the upper chair frame 26*a*, as shown in FIG. 10.

In addition, the seat 58 can have a cushion disposed on a seat base 94, as shown in FIGS. 11*a*-11*d*. Various aspects of the seat base are described in U.S. Pat. Nos. 7,654,617 and 9,351,577, which are hereby incorporated herein by reference. The seat base 94 is disposable on and secured to the seat flame 54. The fasteners jointing the insert 62 to the flanges 82 and 86 can also join the seat base 94 to the seat frame 54. In addition, the attachment insert 62 of the back seat frame portion 42 is sandwiched between the seat base 94 and the distal flange 82 and the intermediate flange 86 of the front seat frame portion 50. An interior of the seat base 94 can be flexible, while a perimeter of the seat base can be rigid. In addition, the chair 14 and/or the chair frame 26 can have mating ganging members 98 for releasably attaching adjacent chairs together in a row. The ganging member 98 can be disposed at the lateral perimeter of the seat frame 54, and can be carried by the seat base 94, and/or coupled between the seat frame 54 and the seat base 94. Various aspects of the ganging members are described in U.S. Pat. No. 9,351,577 and US Patent Application Publication No. 2015-0296986, which are hereby incorporated herein by reference.

Furthermore, the chair 14 and/or the chair frame 26 can have one or more bumpers 102 disposed over the side spars 78 of the front seat frame portion 50 to protect the side spars from the rear legs 30 of an upper chair 14*a* stacked thereon, as shown in FIG. 10. The bumper 102 can be coupled to the seat base 94, and disposed between the seat base 94 and the side spar 78. The seat base 94 can have a notch 106 in the thickness of the seat base or perimeter thereof to receive the bumper 102. In addition, a plurality of tabs 110 (FIG. 12*b*) can extend from the bumper 102 and into holes 114 (FIG. 11*a*) in the seat base 102 to secure the bumper to the seat base.

Although the back and front seat frame portions have been described with structure of the back seat frame portion received inside structure of the front seat frame portion, the structure of the back seat frame portion can be carried by the front piece, and the structure of the front seat frame portion can be carried by the back piece, essentially opposite that described above. Thus, the front seat frame portion can comprise: 1) a front spar extending between the pair of front legs; and 2) an attachment extension extending rearwardly from the front spar and having a distal free end. Similarly, the back seat frame portion can comprise: 1) a rear spar extending between the pair of rear legs: 2) a pair of side spars extending forwardly from the pair of rear legs and having distal free ends; 3) a distal flange extending laterally between the pair of side spars; and 4) an intermediate flange.

Figure 13A:
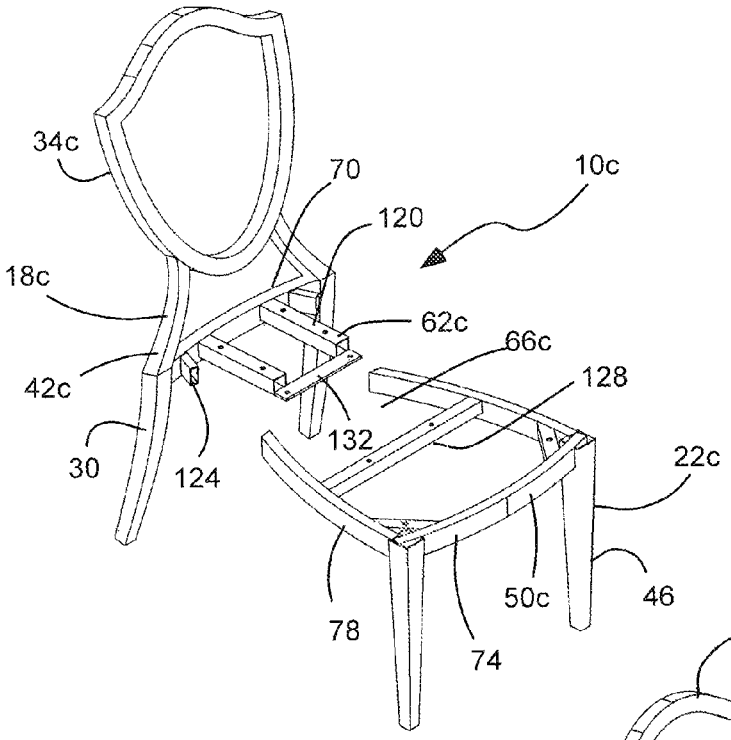
FIG. 13*a* is an exploded perspective view of another chair formed by another two-piece chair frame assembly in accordance with an embodiment of the invention.
Figure 13B:
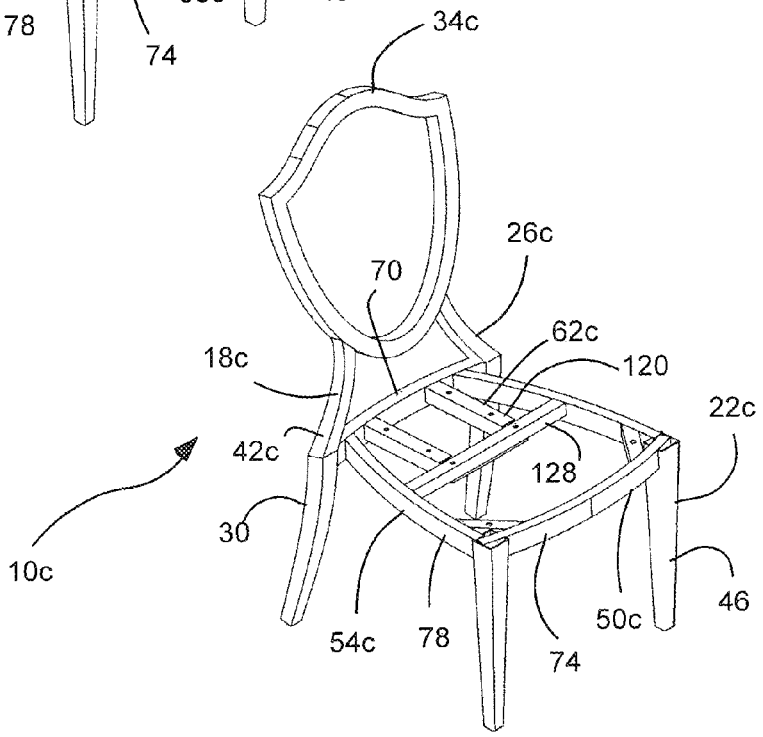
FIG. 13*b* is a perspective view of the chair of FIG. 13*a*

Referring to FIGS. 13*a* and 13*b*, another two-piece chair frame assembly, indicated generally at 10*c*, in another example implementation in accordance with the invention is shown for forming another chair, such as a stackable banquet chair, which is similar to that described above, and which description is hereby incorporated herein by reference. The two-piece chair frame assembly 10*c* has a back piece 18*c* and a front piece 22*c* joined together to form a chair frame 26*c*. The chair frame 26*c* or frame assembly 10*c* can receive and carry a seat cushion disposable on and secured to a seat frame 54*c*, and a backrest cushion secured to and carried by a backrest frame 34*c*. The back piece 18*c* of the chair frame 26*c* or frame assembly 10*c* can comprise a pair of rear legs 30, a backrest frame 34*c* (carrying the backrest with a backrest cushion), and a back seat frame portion 42*c* (or portion of a seat frame disposed at a rear of the seat frame proximate the rear legs and backrest frame). The front piece 22*c* of the chair frame 26*c* or frame assembly 10*c* can comprise a pair of front legs 46, and a front seat frame portion 50*c* (or portion of a seat frame disposed at a front of the seat frame proximate the front legs).

The back seat frame portion 42*c* and the back piece 18*c* can comprise an insert 62*c* insertable into a recess 66*c* of the front seat frame portion 50*c* and the front piece 22*c*. The back and front seat frame portions 42*c* and 50*c* can have structure of the back seat frame portion 18*c* received inside structure of the front seat frame portion 22*c*. In one aspect, the back seat frame portion 18*c* can comprise; 1) a rear spar 70 extending between the pair of rear legs 30; 2) an extension 120 (or pair of extensions) extending forwardly (towards the front seat frame portion) from the rear spar 70, and having a distal free end; and 3) a pair of attachments or inserts 124 extending forwardly from the rear spar 70 outside of the extension 120. The pair of attachments or inserts 124 can be a pair of posts (that can match and inside size and shape of the pair of side spars 78 of the front seat frame portion 50*c*). The front seat frame portion 50*c* can comprise: 1) a front spar 74 extending between the pair of front legs 46; 2) a pair of side spars 78 extending rearwardly (towards the back seat frame portion) from the pair of front legs 46, and having distal free ends; and 3) a center spar or intermediate spar 128 extending laterally between the pair of side spars 78. In addition, the pair of side spars 78 of the front seat frame portion 50*c* can be tubular, defining tubes. The pair of posts of the pair of attachments or inserts 124 can be received in the tubes of the distal free ends of the pair of side spars 78. Furthermore, a flange 132 can be affixed on the distal free end of the extension 120 (or pair of extensions) of the back seat frame portion 42*c*, and can overlap the center or intermediate spar 128 of the front seat frame portion 50*c*. Thus, a distal end of the front seat frame portion 50*c* (namely the distal free ends of the pair of side spars 78) is affixed to a proximal end of the back seat frame portion 42*c* (namely the rear spar 70 or the pair of attachments or inserts 124); and a distal end of the back seat frame portion 42*c* (namely the distal free end of the extension 120 or flange 132) is affixed to an intermediate portion of the front seat frame portion 50*c* (namely the center or intermediate spar 128). The back and front seat frame portions 42*c* and 50*c* can be joined together with: 1) the distal free ends of the pair of side spars 78 of the front seat frame portion 50*c* being affixed to the pair of attachments or inserts 124 of the back seat frame portion 42*c*; and 2) the distal free end of the extension 120 (or flange 132) of the back seat frame portion 42*c* being affixed to the center or intermediate spar 128 of the front seat frame portion 50*c*. The overlapping (posts in tubes and flange on spar, and insert extending into the recess) of the front and rear seat frame portions 42*c* and 50*c* can provide a solid connection between the back and front pieces 18*c* and 22*c*. The connection can be further strengthened by the seat, or seat base thereof. The distal free ends of the pair of side spars 78 of the front seat frame portion 50*c* can be coupled to the rear spar 70 of the back seat frame portion 42*c* solely by insertion of the pair of posts 124 in the tubes (without mechanical fasteners); and the distal free end (or flange 132) of the extension 120 of the back seat frame portion 42*c* can be coupled to the center or intermediate spar 128 of the front seat frame portion 50*c* solely by one mechanical fastener in one aspect, or two or less mechanical fasteners in another aspect. The mechanical fasteners can be screws or bolts or the like. Thus, the chair can be easily and quickly assembled. A method for assembling the back and front pieces 18*c* and 22*c*, and the back and front seat frame portions 42*c* and 50*c*, can include: 1) aligning the side spars 78 (or open distal ends thereof) with the pair of extensions or inserts 124 (or posts); 2) inserting the posts into the tubes; and 3) fastening the distal end of the extension 120 or flange 132 to the center or intermediate spar 128 with fasteners. The backrest and seat can then be secured to the backrest frame 34*c* and the seat frame 54*c*, respectively, such as with fasteners.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A two-piece chair frame assembly device, comprising:

a) a back piece and a front piece joined together to form a chair frame, the back and front pieces being separate and discrete pieces until joined together;

b) the back piece comprising a pair of rear legs, a backrest frame, and a back seat frame portion;

c) the front piece comprising a pair of front legs and a front seat frame portion;

d) the front and back seat frame portions joining together to form a seat frame;

e) the back seat frame portion comprising:

i) a rear spar extending between the pair of rear legs; and ii) an attachment insert extending forwardly from a proximal end at the rear spar to a distal free end; and f) the front seat frame portion comprising:

i) a front spar extending between the pair of front legs;

ii) a pair of side spars extending rearwardly from the pair of front legs to distal free ends;

iii) a distal flange extending laterally between the distal free ends of the pair of side spars; and iv) an intermediate flange at an intermediate point of the pair of side spars;

g) the back and front seat frame portions joining together with the attachment insert inserted between the pair of side spars of the front seat frame portion, and with:

i) the distal free end of the attachment insert of the back seat frame portion being affixed to the intermediate flange of the front seat frame portion so that the attachment insert of the back seat frame portion is attached to the pair of side spars of the front seat frame portion at the intermediate portion of the pair of side spars; and ii) the proximal end of the attachment insert of the back seat frame portion being affixed to the distal flange of the front seat frame portion so that the attachment insert of the back seat frame portion is attached to the pair of side spars of the front seat frame portion at the distal ends of the pair of side spars.

2. The device in accordance with claim 1, wherein the back and front pieces have different surface characteristics, comprising at least one of:

a) a color of the pair of front legs being different than a color of the pair of rear legs or the backrest frame;

b a surface finish of the pair of front legs being different than a surface finish of the pair of rear legs or the backrest frame; or c) combinations thereof.

3. The device in accordance with claim 1, wherein an entire surface of the pair of front legs, the front spar, and the pair of side spars of the front piece has a first surface characteristic, and an entire surface of the pair of rear legs, the rear spar and the backrest frame of the back piece has a second surface characteristic different from the first surface characteristic.

4. The device in accordance with claim 1, further comprising:

a seat disposed on and secured to the seat frame; and the attachment insert of the back seat frame portion being sandwiched between the seat and the distal flange and the intermediate flange of the front seat frame portion.

5. The device in accordance with claim 1, further comprising:

a seat cushion disposable on and secured to the seat frame; and a backrest cushion secured to and carried by the backrest frame.

6. The device in accordance with claim 1, wherein the attachment insert is recessed inwardly with respect to the pair of rear legs; wherein the pair of side spars taper inwardly and rearwardly from the pair of front legs to the rear spar; and wherein the chair frame is a chair frame of a first chair stackable on top of a chair frame of a second chair identical in structure to the first chair and with a pair of side spars of the chair frame of the second chair received within the rear legs of the chair frame of the first chair.

7. The device in accordance with claim 1, wherein the back and front pieces are removably joined together.

8. A method for assembling the device in accordance with claim 1, comprising:

inserting the attachment insert of the back seat frame portion between the pair of side spars of the front seat frame portion;

attaching the attachment insert of the back seat frame portion to the distal flange and the intermediate flange of the front seat frame portion forming the seat frame; and attaching a seat to the seat frame with the attachment insert between the seat and the distal flange and the intermediate flange of the front seat frame portion.

9. A method for assembling the device in accordance with claim 1, comprising:

selecting the back piece with a desired first surface characteristic from a group of back frame pieces with difference surface characteristics;

selecting the front piece with a desired second surface characteristic from a group of front frame pieces with difference surface characteristics; and joining the back piece to the front piece to form the chair frame.

10. A two-piece chair frame assembly device, comprising:

a) a back piece and a front piece joined together to form a chair frame, the back and front pieces being separate and discrete pieces until joined together;

b) the back piece comprising a pair of rear legs, a backrest frame, a back seat frame portion, and an attachment insert extending forwardly from a proximal end at the hack seat frame portion to a distal free end;

c) the front piece comprising a pair of front legs, a front seat frame portion, and a pair of side spars extending rearwardly from the pair of front legs to distal free ends;

d) the front and back seat frame portions joining together to form a seat frame with the attachment insert inserted between the pair of side spars; and e) wherein the attachment insert is recessed inwardly with respect to the pair of rear legs; wherein the pair of side spars taper inwardly and rearwardly from the pair of front legs to the back seat frame portion; and wherein the chair frame is a chair frame of a first chair stackable on top of a chair frame of a second chair identical in structure to the first chair and with a pair of side spars of the chair frame of the second chair received within the rear legs of the first chair.

11. The device in accordance with claim 10, wherein an entire surface of the front piece has a first surface characteristic, and an entire surface of the back piece has a second surface characteristic different from the first surface characteristic.

12. The device in accordance with claim 10, further comprising:

a seat disposed on and secured to the seat frame; and a distal flange extending laterally between the distal free ends of the pair of side spars;

an intermediate flange at an intermediate point of the pair of side spars; and the attachment insert of the back seat frame portion being sandwiched between the seat and the distal flange and the intermediate flange of the front seat frame portion.

13. The device in accordance with claim 10, wherein the back and front pieces have different surface characteristics comprising at least one of:

a) a color of the pair of front legs being different than a color of the pair of rear legs or the backrest frame;

b) a surface finish of the pair of front legs being different than a surface finish of the pair of rear legs or the backrest frame; or c) or combinations thereof.

14. The device in accordance with claim 10, further comprising:

a) the front seat frame portion comprising:

i) a distal flange extending laterally between the distal free ends of the pair of side spars; and ii) an intermediate flange at an intermediate point of the pair of side spars; and b the back and front seat frame portions joining together with:

i) the distal free end of the attachment insert of the back seat frame portion being affixed to the intermediate flange of the front seat frame portion; and ii) the proximal end of the attachment insert of the back seat frame portion being affixed to the distal flange of the front seat frame portion.

15. The device in accordance with claim 10, wherein the pair of front leg and the pair of back legs has the different surface characteristics therebetween.

16. The device in accordance with claim 10, wherein the back and front pieces are removably joined together.

17. The device in accordance with claim 10, wherein the back seat frame portion comprises the insert insertable into a recess of the front seat frame portion.

18. A two-piece chair frame assembly device, comprising:

a) a back piece and a front piece removably joined together to form a chair frame, the back and front pieces being separate and discrete pieces until joined together;

b) the back piece comprising a pair of rear legs, a backrest frame, and a back seat frame portion;

c) the front piece comprising a pair of front legs, a front seat frame portion, a pair of side spars extending rearwardly from the pair of front legs to distal free ends, a distal flange extending laterally between the distal free ends of the pair of side spars, and an intermediate flange at an intermediate point of the pair of side spars;

d) the front and back seat frame portions joining together to form a seat frame; and e) the back seat frame portion comprises an attachment insert insertable into a recess of the front seat frame portion with a distal free end of the attachment insert being affixed to the intermediate flange so that the attachment insert of the back seat frame portion is attached to the pair of side spars of the front seat frame portion at the intermediate portion of the pair of side spars, and with a proximal end of the attachment insert being affixed to the distal flange so that the attachment insert of the back seat frame portion is attached to the pair of side spars of the front seat frame portion at the distal ends of the pair of side spars.

19. The device in accordance with claim 18, wherein an entire surface of the front piece has a first surface characteristic, and an entire surface of the back piece has a second surface characteristic different from the first surface characteristic.

20. The device in accordance with claim 18, wherein the attachment insert is recessed inwardly with respect to the pair of rear legs; wherein the pair of side spars taper inwardly and rearwardly from the pair of front legs to the back seat frame portion; and wherein the chair frame is a chair frame of a first chair stackable on top of a chair frame of a second chair identical in structure to the first chair and with a pair of side spars of the chair frame of the second chair received within the rear legs of the chair frame of the first chair.

* * * * *